US008162160B2

(12) United States Patent
Zollondz et al.

(10) Patent No.: US 8,162,160 B2
(45) Date of Patent: Apr. 24, 2012

(54) MODULAR COUNTERWEIGHT CARRIAGE FOR CRANES, IN PARTICULAR FOR LARGE CRANE

(75) Inventors: Rüdiger Zollondz, Hornbach (DE); Alfons Weckbecker, Zweibruecken (DE); Fritz-Botho Köster, Rockenhausen (DE); Günter Karp, Herschberg (DE); Hans-Peter Franzen, Walshausen (DE)

(73) Assignee: Terex Demag GmbH, Zweibruecken (DE)

( * ) Notice: Subject to any disclaimer, the term of this patent is extended or adjusted under 35 U.S.C. 154(b) by 0 days.

(21) Appl. No.: 12/085,127

(22) PCT Filed: Oct. 13, 2006

(86) PCT No.: PCT/DE2006/001844

§ 371 (c)(1),
(2), (4) Date: May 16, 2008

(87) PCT Pub. No.: WO2007/056970

PCT Pub. Date: May 24, 2007

(65) Prior Publication Data

US 2009/0272708 A1 Nov. 5, 2009

(30) Foreign Application Priority Data

Nov. 17, 2005 (DD) ..... 10 2005 055 693
Mar. 1, 2006 (DE) ..... 10 2006 020 488

(51) Int. Cl.
*B66C 23/76* (2006.01)

(52) U.S. Cl. ..... 212/196; 212/198; 212/197

(58) Field of Classification Search ..... 212/195, 212/196, 197, 198, 178, 301, 308
See application file for complete search history.

(56) References Cited

U.S. PATENT DOCUMENTS

| | | | | | |
|---|---|---|---|---|---|
| 2,068,397 | A | * | 1/1937 | Chapman | 212/195 |
| 3,842,984 | A | | 10/1974 | Brown et al. | |
| 4,266,679 | A | | 5/1981 | Juergens | |
| 4,360,111 | A | * | 11/1982 | Weiskopf | 212/196 |
| 4,508,232 | A | * | 4/1985 | Lampson | 212/178 |
| 4,540,097 | A | * | 9/1985 | Wadsworth et al. | 212/196 |
| 4,557,390 | A | * | 12/1985 | Mick | 212/197 |
| 4,579,234 | A | * | 4/1986 | Delago et al. | 212/178 |
| 4,601,402 | A | * | 7/1986 | Helm et al. | 212/301 |
| 4,614,275 | A | | 9/1986 | Zenno | |
| 4,711,358 | A | * | 12/1987 | Konishi | 212/178 |
| 4,716,729 | A | * | 1/1988 | Kakeya | 60/426 |
| 5,281,078 | A | * | 1/1994 | Mills, Jr. | 414/680 |
| 6,283,315 | B1 | * | 9/2001 | Willim et al. | 212/196 |
| 6,568,547 | B1 | * | 5/2003 | Kretschmer et al. | 212/196 |

FOREIGN PATENT DOCUMENTS

| | | | |
|---|---|---|---|
| DE | 44 18 785 | | 11/1995 |
| EP | 0 048 076 | | 3/1982 |
| GB | 2 046 701 | | 11/1980 |
| GB | 2 140 772 | | 12/1984 |
| GB | 2 149 750 | A * | 1/1987 |
| JP | 09-272457 | | 10/1997 |

OTHER PUBLICATIONS

Search Report dated Feb. 7, 2007 issued for the underlying International PCT Application No. PCT/DE2006/001844.

* cited by examiner

*Primary Examiner* — Michael Mansen
*Assistant Examiner* — Juan Campos, Jr.
(74) *Attorney, Agent, or Firm* — Browdy and Neimark, PLLC

(57) ABSTRACT

A large mobile crane includes a revolving superstructure, a main boom hinged to the superstructure, and a derrick boom hinged to the superstructure. A modular counterweight system includes a traveling counterweight and a non-traveling counterweight connected to a crossbeam suspended from the distal end of the derrick boom so that the non-traveling counterweight is activated before the traveling counterweight.

15 Claims, 5 Drawing Sheets

MODULAR COUNTERWEIGHT CARRIAGE FOR CRANES, IN PARTICULAR FOR LARGE CRANE

CROSS-REFERENCE TO RELATED APPLICATIONS

This is a U.S. national stage of International Application No. PCT/DE2006/001844, filed on 13 Oct. 2006. Priority is claimed on German Application No. 10 2005 055 693.0, filed on 17 Nov. 2005, and German Application No. 10 2006 010 488.9, filed on 1 Mar. 2006.

BACKGROUND OF THE INVENTION

1. Field of the Invention

The invention pertains to all cranes equipped with counterweight carriages, especially to large cranes with a superstructure, with at least one main boom and at least one derrick boom, and with a separate counterweight connected to the tip of the derrick boom.

2. Description of the Related Art

The invention can be used for various types of cranes. These will be explained briefly in the following. In all cases, a main boom 1 and a derrick boom 2 are hinged to a common structure, which is referred to as the superstructure 3. In the case of an inventive crane, the superstructure 3 can move with at least one degree of freedom with respect to the ground or its foundation structure. The various types of cranes differ with respect to their degrees of freedom. In the case of a mobile crane (FIG. 1), the superstructure 3 is connected rotatably to an undercarriage 4, which can travel over the ground on crawlers or wheels. In the case of an outrigger crane, the superstructure is connected rotatably to a chassis, which stands on outriggers resting on the ground or on a pontoon. Mobile cranes can also be combined with outriggers. Another type of crane is the ring-lift crane, where the superstructure rides on a ring-shaped track. The track does not necessarily have to be closed and does not even have to be circular. Other types of cranes can also be imagined, as long as the superstructure has at least one degree of freedom with respect to the ground or its foundation structure, where the term "foundation structure" is understood here to include undercarriages, outriggers, and ring-shaped tracks.

The crane shown here by way of example belongs to the prior art and is a lattice-boom crawler crane, which operates according to the derrick crane principle; that is, the basic machine is designed without ballast and makes no contribution to the stability moment.

So that large loads can be lifted, a relatively large counterweight must be provided because of the basic machine's complete or almost complete the lack of contribution to the stability moment. When the crane rotates or travels, this counterweight must be carried along, too. Known solutions include ballast arrangements which are either lifted from the ground or rest on counterweight carriages with crawlers or wheels.

The disadvantage of the non-traveling ballast arrangements is that, in the case of small-to-medium loads, it is not always possible to raise the ballast, and in the case of derrick cranes it is not usually allowable to do so.

The high ballast weights required to achieve high lifting capacities, however, require large-sized, complicated, and expensive traveling designs. For this purpose, counterweight carriages with either crawlers (Lampson) or wheels have been used so far. In addition to the approach used predominantly in the past in engineering practice, namely, to build a single carriage of appropriate size, it is also possible to use two carriages in a tandem arrangement. Both solutions are complicated, expensive, and hardly suitable for application to small cranes.

The basic idea is explained in the following on the basis of the degree of rotational freedom of a mobile crane. The explanation also applies, however, to general movement of the superstructure in a horizontal plane.

Underneath the previously mentioned derrick boom 2 there is a superlift counterweight 5. This is connected to the tip of the derrick boom 2 by the superlift carrier rods 6. The superlift carrier rods can also be designed as cables, chains, hydraulic cylinders, or other tension elements, and any desired number of them can be provided. The derrick boom 2 is connected to the main boom 1 by main boom retaining rods 7 (whether cables or rods or other tension elements are used is unimportant for the invention). A load 8 on the main boom 1 generates a force in the main boom retaining rods 7, which generates in turn a force in the superlift carrier rods 6. The superlift counterweight 5, which corresponds to the force in the superlift carrier rods (in 6), is referred to as an "activated" superlift counterweight.

So that the crane can rotate, the superlift counterweight 5 is placed on or attached to a counterweight carriage 9. The counterweight carriage has undercarriage with wheels 10 or crawlers 10*a*,10*b*. FIGS. 5 and 6 schematically show the counterweight carriage with hydraulic cylinders 20*a*, 20*b*, and reeved cables 21*a*, 21*b*, respectively, connecting the additional counterweight 16 to the crossbeam 14.

SUMMARY OF THE INVENTION

The task of the present invention is to provide a modular counterweight system which offers the maximum superlift counterweight for the crane in question without requiring a correspondingly large carriage, where the mobility of the crane continues to be guaranteed.

According to the invention, the superstructure has at least one degree of freedom of movement versus the ground or its foundation structure, and the counterweight is divided into a traveling counterweight and a non-traveling counterweight, the two counterweights being connected to each other and to the derrick boom in such a way that the non-traveling counterweight can be activated before the traveling counterweight.

The one or more counterweights are divided in such a way that the lifting capacity of the traveling counterweight is less than the maximum superlift counterweight possible for the particular crane in question, and in that the non-traveling counterweight makes up the difference between that and the maximum possible superlift weight.

What the superstructure is mounted on is not essential to the invention; that is, it doesn't matter whether it is mounted on a traveling undercarriage, for example, or on a stationary structure resting at least temporarily on the ground.

The essential point is that the superstructure must have at least one degree of freedom of movement versus the ground or its foundation structure, i.e., it must be able to move in the horizontal plane (around the vertical axis) and in particular be able to rotate.

The undercarriage can travel over the ground by means of crawlers or wheels. The superstructure can also be designed as a ring-lift device with the ability to rotate in a horizontal plane on an open or closed ring-shaped track resting on the ground.

According to an inventive elaboration, a crossbeam is provided above the traveling counterweight. This crossbeam is connected in the upward direction to the tip of the derrick boom and in the downward direction both to the traveling counterweight and also to the non-traveling counterweight.

The connection between the crossbeam and the traveling counterweight is designed in such a way that the non-traveling counterweight is lifted first, before the traveling counterweight is activated. A simple design consists of a chain between the crossbeam and the traveling counterweight, the length of the chain being calculated so that it does not become taut until after the non-traveling counterweight has been lifted. Alternatively, rods with a joint or a pin in a slot can be provided instead of a chain.

According to another advantageous design, at least one hydraulic cylinder or reeved cable is provided between the non-traveling counterweight and the crossbeam. As a result, it is possible to vary the length of the connection.

As a result of this inventive design, it becomes possible to reverse the sequence of activation, so that the traveling counterweight is activated first. This makes it possible to make the connection between the crossbeam and the non-traveling counterweight free of force. In this state, the complete non-traveling counterweight can be separated from the crossbeam.

The counterweight can consist of several traveling and non-traveling units which are arranged next to each other, one behind the other, or offset from each other.

The several traveling and non-traveling counterweights can be connected to each other by one or more crossbeams, permanently or detachably, which are arranged next to each other, one behind the other, or offset from each other.

The traveling counterweight can be equipped with its own drive unit.

The traveling counterweight is also referred to below as the "counterweight carriage".

DETAILED DESCRIPTION OF THE PREFERRED EMBODIMENTS

In the present case, a solution made up of existing traveling components and existing or specially designed non-traveling counterweight components is used.

Figure 1:
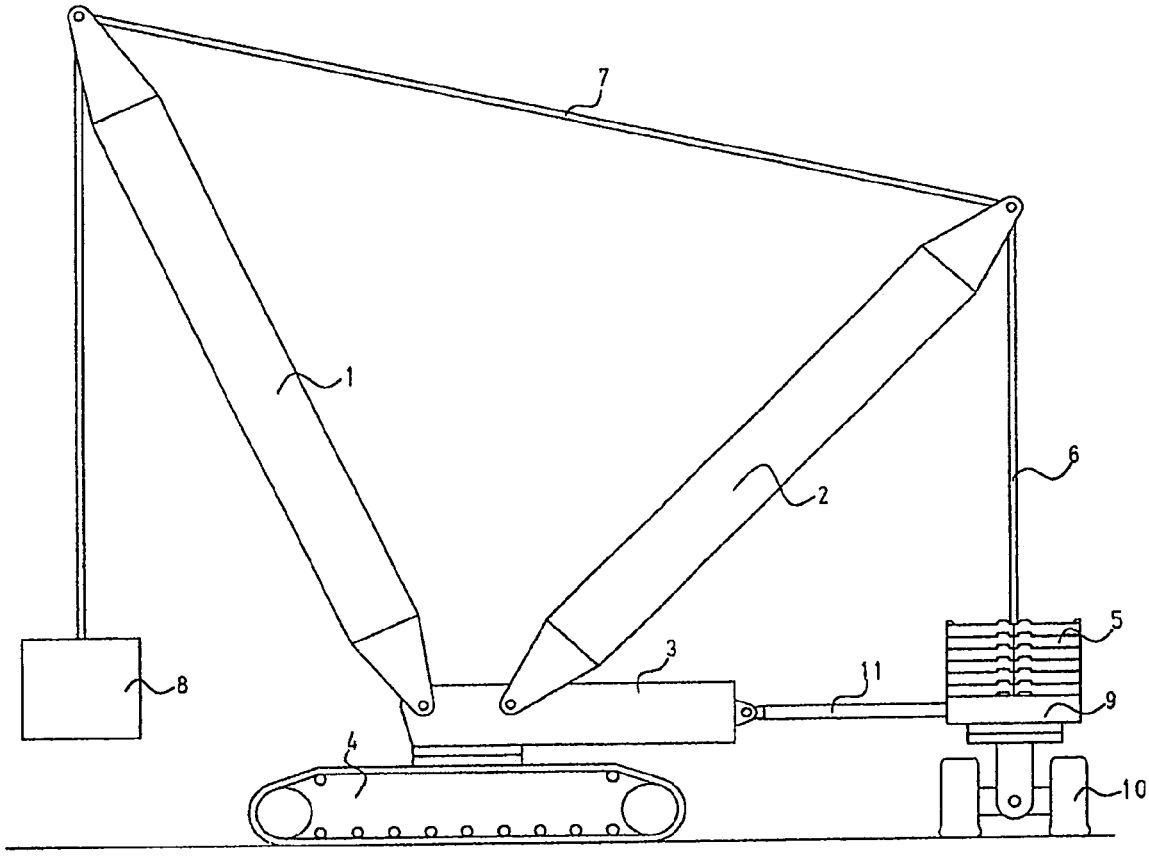
FIG. 1 (PRIOR ART)
FIG. 1 shows a crane with a main boom-derrick boom arrangement according to the prior art.
Figure 2:
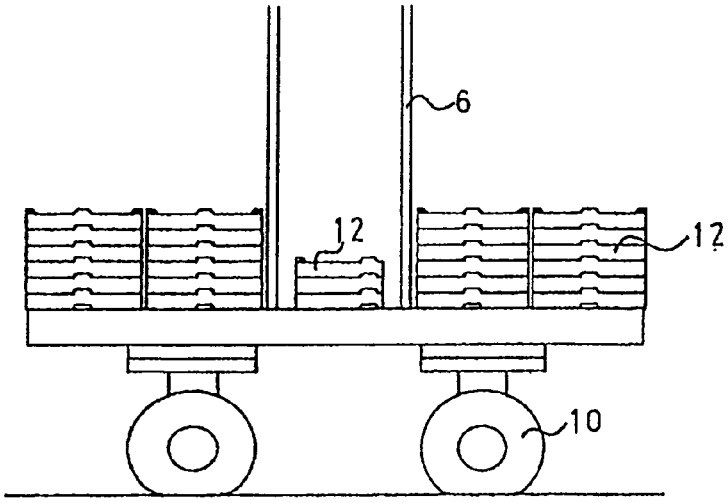
FIG. 2 shows a counterweight carriage.
Figure 3:
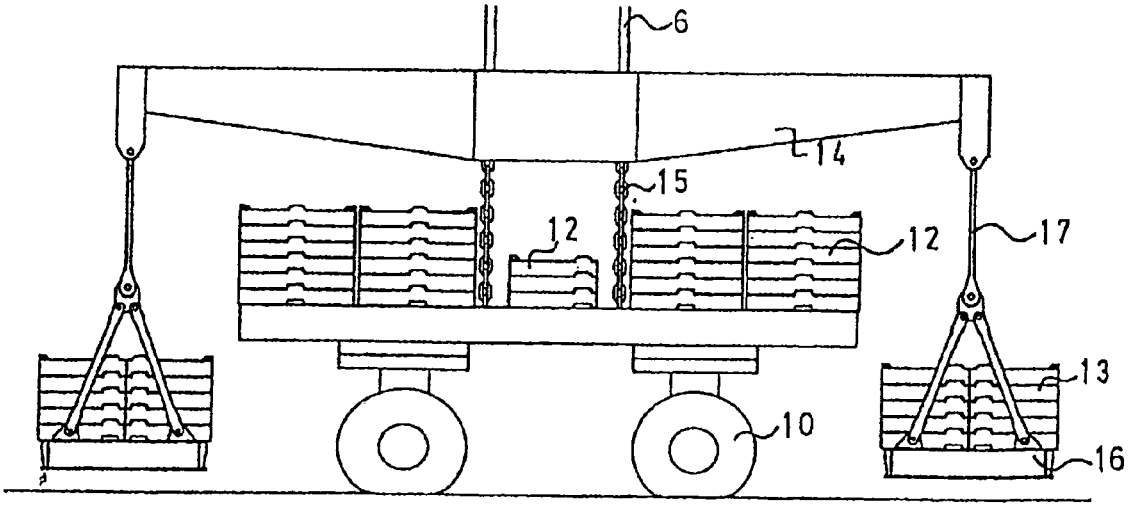
FIG. 3 shows an arrangement of traveling and non-traveling counterweight carriage components.
Figure 4:
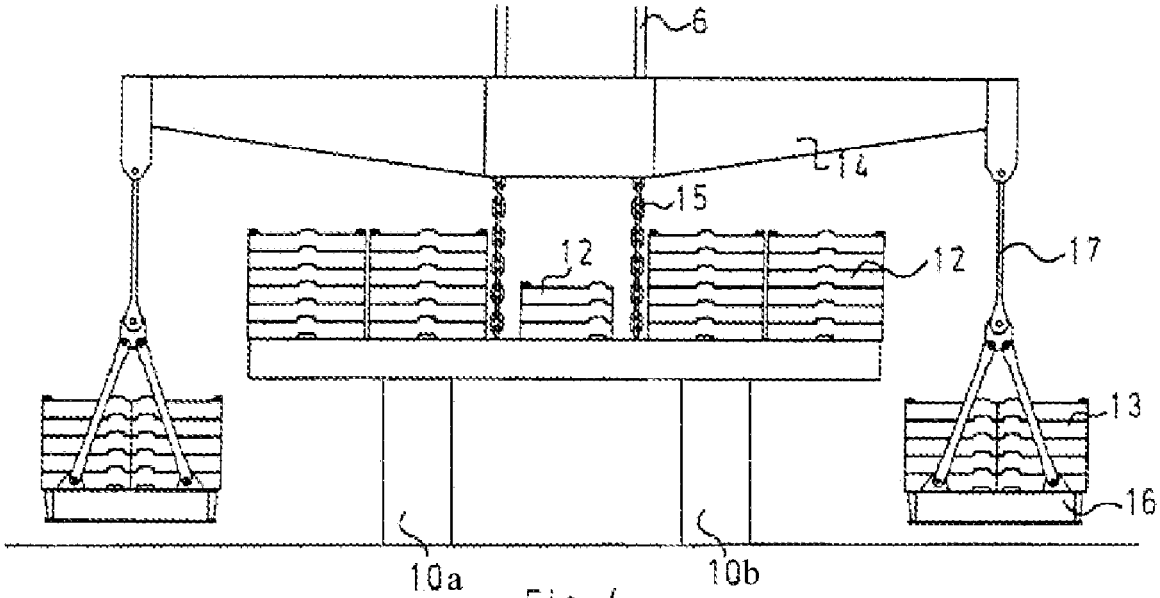
FIG. 4 schematically shows a counterweight carriage supported by crawlers.
Figure 5:
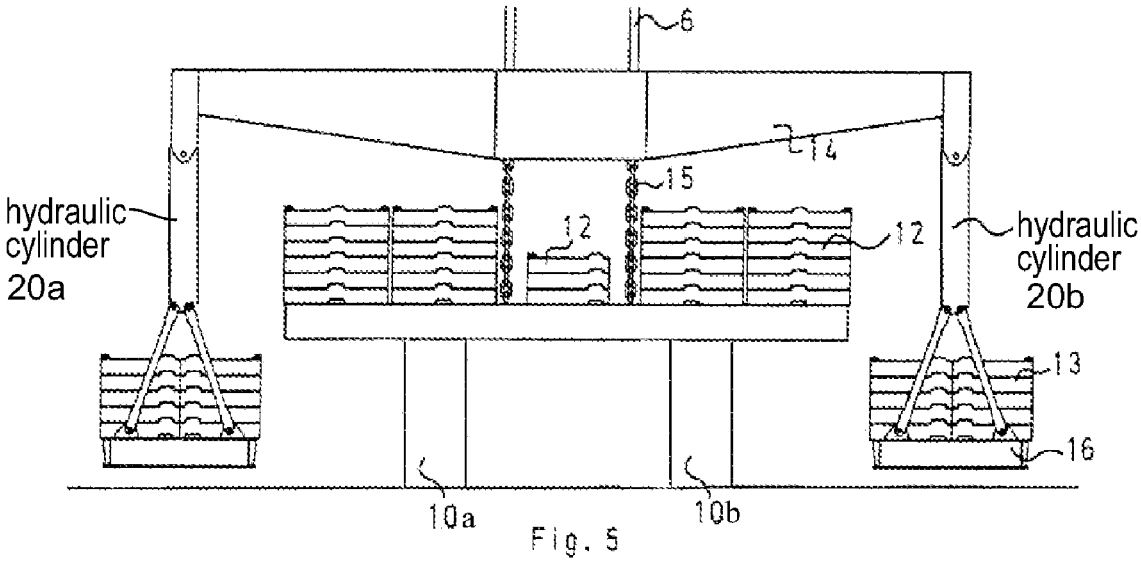
FIG. 5 schematically shows a counterweight carriage with hydraulic cylinders.
Figure 6:
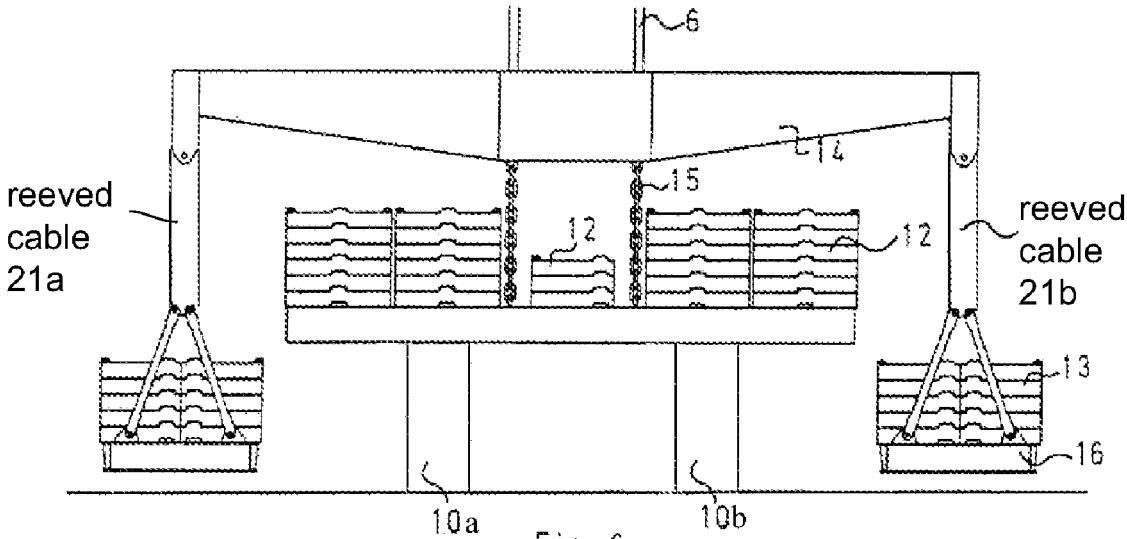
FIG. 6 schematically shows a counterweight carriage with reeved cables.

Referring to FIG. 3, a crossbeam 14 is provided above the traveling counterweight 12. This crossbeam is connected in the upward direction to the tip of the derrick boom 2 by carrier rods 6, and in the downward direction both to the traveling counterweight 12 and also to the non-traveling counterweight 13.

The connection between the crossbeam 14 and the traveling counterweight 12 is designed in such a way that the non-traveling counterweight 13 is lifted first, before the traveling counterweight 12 is activated. A simple design consists of a chain 15 between the crossbeam 14 and the traveling counterweight carriage 9, the length of the chain 15 being calculated so that it does not become taut until after the non-traveling counterweight 13 has been lifted. Alternatively, rods with a joint or a pin in a slot can be provided instead of a chain. A pair of non-traveling counterweights 13 are carried on pallets 16 which are connected to opposite ends of the beam 14 by rods 17.

In compliance with the applicable codes, the counterweight is selected so that the test load associated with the nominal lifting capacity can be lifted; that is, at nominal load only part of this counterweight is activated (lifted, without direct or indirect contact with the ground). Only the remainder, the so-called "test load reserve", must be carried along during the rotation or traveling of the crane with a suspended load. Sufficient for this is an existing, standard counterweight carriage 9, which is supplemented with an additional counterweight 13. Because the counterweight carriage cannot carry the increased counterweight, it remains on the ground initially and is, according to the invention, connected to the tip of the main boom, so that this part of the counterweight is activated first, and only after that is the counterweight located on the counterweight carriage activated.

The design of the existing counterweight carriage 9, preferably with its own drive, also offers the advantage that no additional rotating mechanisms are required in the basic machine in order to rotate the larger masses thus generated. The test load reserve present on the counterweight carriage at all times ensures that slippage is effectively avoided and that the drive power can be transmitted.

The use of the inventive crane with a counterweight carriage which does not have to be designed for the entire superlift counterweight leads to the following advantages:

(a) achievement of the largest possible lifting capacities and radii at modest additional investment cost (only the conversion parts need to be kept on hand);

(b) more effective utilization of the basic investment, because the crane can still work at its original capacity; and (c) only the counterweight expansion parts need to be transported from one construction site to the next so that cranes of different capacities, especially large cranes, can be built at different locations.

What is claimed is:

1. A crane comprising:

a superstructure having at least one degree of freedom relative to a ground or a foundation structure;

a main boom hinged to the superstructure;

a derrick boom hinged to the superstructure and having a distal end; and a total counterweight that is divided into a counterweight carriage separate from the superstructure, said counterweight carriage supporting a first counterweight, and an additional counterweight connected to the distal end of the derrick boom, wherein the first and additional counterweights are connected to one another and to the derrick boom so that the additional counterweight is activated before the counterweight carriage, and the additional counterweight remains on the ground initially.

2. The crane of claim 1 wherein the crane has a lifting capacity defined as a superlift weight, and requires a superlift counterweight to balance the superlift weight, wherein the total of the weight of the first counterweight and the weight of the additional counterweight equals the weight of the superlift counterweight.

3. The crane of claim 1 further comprising a crossbeam suspended from the distal end of the derrick boom, the counterweight carriage and the additional counterweight being connected to the crossbeam.

4. The crane of claim 3 wherein the counterweight carriage and the additional counterweight are connected to the crossbeam so that the additional counterweight is lifted before the counterweight carriage is activated.

5. The crane of claim 3 wherein the crossbeam is connected to the additional counterweight by a hydraulic cylinder.

6. The crane of claim 3 wherein the crossbeam is connected to the additional counterweight by a reeved cable.

7. The crane of claim 3 wherein at least one of the first counterweight and additional counterweight comprises a plurality of counterweights.

8. The crane of claim 3, wherein the additional counterweight comprises two additional counterweight units suspended in tandem along the crossbeam.

9. The crane of claim 8 wherein the additional counterweight units are arranged at opposite ends of the crossbeam, with the counterweight carriage there between.

10. The crane of claim 1 wherein the counterweight carriage is equipped with a drive.

11. The crane of claim 10 wherein the counterweight carriage is equipped with crawlers.

12. The crane of claim 1 further comprising a traveling undercarriage which serves as the foundation structure, the superstructure being rotatable relative to the traveling undercarriage.

13. The crane of claim 12 wherein the travelling undercarriage is equipped with crawlers.

14. A crane comprising:

a superstructure with at least one degree of freedom with respect to a ground or a foundation structure of the crane;

at least one main boom;

at least one derrick boom; and a separate superlift counterweight that is divided into a first counterweight and an additional counterweight, said first counterweight supported on a counterweight carriage, wherein the separate superlift counterweight is connected to a tip of the derrick boom and wherein the additional counterweight is activated before the counterweight carriage, wherein the additional counterweight comprises a crossbeam suspended from a distal end of the derrick boom, and the counterweight carriage and the additional counterweight are connected to the crossbeam, wherein the additional counterweight comprises a plurality of counterweight elements, wherein the counterweight elements are suspended in tandem along the crossbeam, and wherein the additional counterweight is divided in two parts and each is arranged at one of the opposite ends of the crossbeam, with the counterweight carriage located beneath them.

15. A crane comprising:

a superstructure having at least one degree of freedom relative to the ground or a foundation structure;

a main boom hinged to the superstructure;

a derrick boom hinged to the superstructure and having a distal end; and a total counterweight that is divided into a counterweight carriage and additional counterweights, both separate from the superstructure, said counterweight carriage supporting a first counterweight, and a crossbeam connected to the distal end of the derrick boom, wherein the first and additional counterweights are connected to one another through the crossbeam so that the additional counterweights are activated before the counterweight carriage.

* * * * *

UNITED STATES PATENT AND TRADEMARK OFFICE

CERTIFICATE OF CORRECTION

PATENT NO. : 8,162,160 B2
APPLICATION NO. : 12/085127
DATED : April 24, 2012
INVENTOR(S) : Zollondz et al.

It is certified that error appears in the above-identified patent and that said Letters Patent is hereby corrected as shown below:

On the cover page of the issued patent at Section 30 Foreign Application Data, delete "Mar. 1, 2006 (DE) 10 2006 020 488" and insert --Mar. 1, 2006 (DE) 10 2006 010 488--.

Signed and Sealed this
Ninth Day of October, 2012

David J. Kappos

David J. Kappos
*Director of the United States Patent and Trademark Office*